United States Patent [19]

Mall et al.

[11] Patent Number: 4,573,421

[45] Date of Patent: Mar. 4, 1986

[54] SEWING MACHINE DEVICE FOR MAKING GARMENTS WITH PLEATS

[75] Inventors: Günther Mall; Herbert Dietrich; Willi Stephan, all of Kaiserslautern, Fed. Rep. of Germany

[73] Assignee: Pfaff Industriemaschinen GmbH, Fed. Rep. of Germany

[21] Appl. No.: 745,009

[22] Filed: Jun. 14, 1985

[30] Foreign Application Priority Data

Oct. 18, 1984 [DE] Fed. Rep. of Germany ..... 8430596

[51] Int. Cl.[4] ..... D05B 35/08

[52] U.S. Cl. ..... 112/146; 223/35

[58] Field of Search ..... 112/146, 136, 137, 144; 223/38, 35, 28

[56] References Cited

U.S. PATENT DOCUMENTS 4,022,138 5/1977 Strickland ..... 112/146

4,418,629 12/1983 Mall et al. ..... 112/146

*Primary Examiner*—H. Hampton Hunter

*Attorney, Agent, or Firm*—McGlew and Tuttle

[57] ABSTRACT

A device for use with a sewing machine for making garments with pleats operates with a folded-over workpiece which is advanced past a reciprocating sewing needle and includes a pleating bar assembly which is insertable between the folds of the material and includes portions which engage against the folds of the material to hold a pleat in position while it is moved by a feed pressure member into a sewing position. The pleating bar assembly includes a supporting member such as a shaft or a rod having pleat members with bearing portions which are rotatable on the support member to permit the plates to be held in position and to be collapsed for bringing the pleat to a sewing position. The material is held by needle or pin members which engage into the material as it is fed into the sewing position.

12 Claims, 10 Drawing Figures

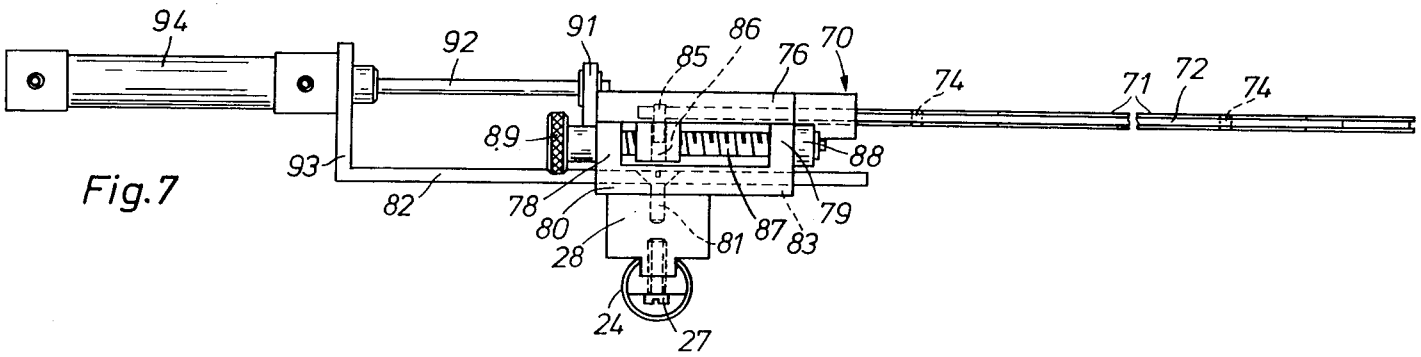
Fig. 7
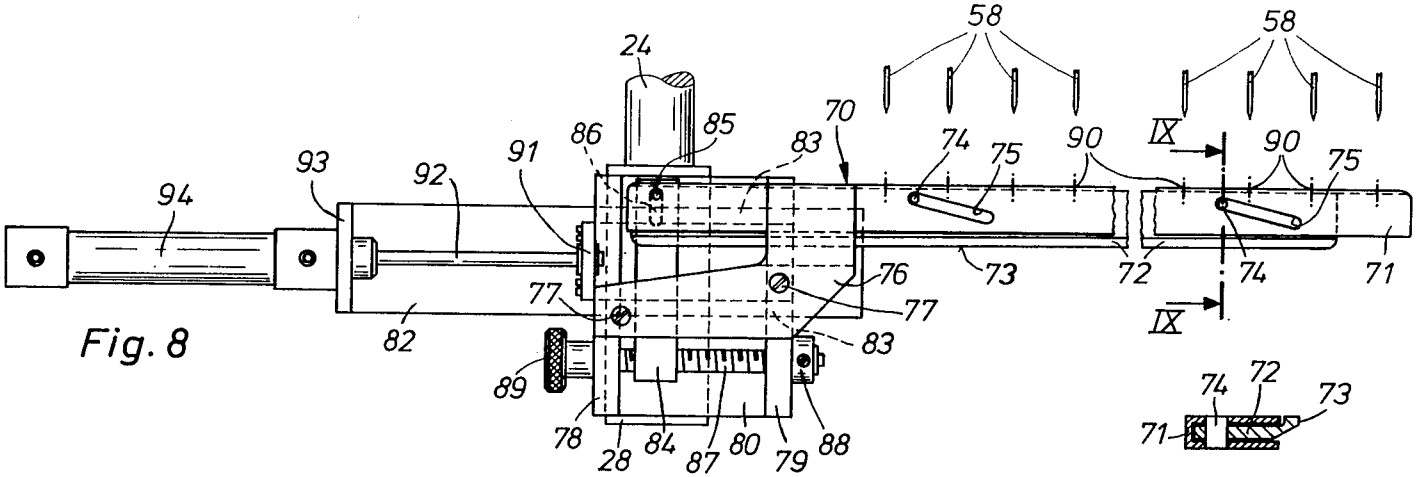
Fig. 8
Fig. 9

SEWING MACHINE DEVICE FOR MAKING GARMENTS WITH PLEATS

FIELD AND BACKGROUND OF THE INVENTION

This invention relates in general to sewing machines and in particular to a new and useful device for use with a sewing machine for making garments with pleats.

The working of pleated skirts with so-called inverted pleats, known also as double plates and used for example also in coats or, otherwise plain, women's skirts as a fashion detail to provide additional width in the leg movement region, is rendered difficult by the fact that the seamstress cannot see the second crease to be brought into coincidence with the first crease before the sewing of the center part of a pre-ironed inverted pleat in preparing the work before sewing, because this crease edge is cancealed by the upper ply.

Not only is the handling time consuming, but despite careful and attentive working deficient results are inevitable with respect to regularity of the pleats and the obtaining of a trapeze or bell form adapted to the wearer's body form, the more so as the pleat width at the band and at the end of the seam is different.

From U.S. Pat. No. 4,418,629 (German Utility Model 80 27 080) an apparatus is known for making pleated skirts with single pleats where the position of the here single crease per pleat is marked by notches at the edge of the cut part which are made when cutting the pattern or thereafter. The known apparatus comprises a one-piece pleating bar exchangeably arranged at a support movable on guides between a charging position and a transfer position, the pleating bar having a contact edge on the side away from the operator, the cut part being placed thereon in the charging position from the side, folded so that the crease-marking notch is at the contact edge of the pleating bar and the folded plies of the cut part lie one on top of the other flush with the band.

The cut part thus prepared is then moved from the charging position of the pleating bar into the transfer position under a feed pressure strip which is lowered onto the area to be sewn next to the intended seam line, in order thereafter to pass the cut part along the stitch-forming point of a sewing machine to form a seam.

To change the pleat width, e.g. when changing the garment size, the pleating bar can be moved into several positions determined by adjustable stops.

The apparatus is very suitable for making pleated skirts with single pleats, and it is easy and convenient to reset to different pleat depths.

Since, however, the width of inverted pleats is determined mainly by the width of the pleating bar and the positioning at the sewing station, and since the seam at an inverted pleat is laid by the abutting fold edges under the center part of the visible side of the garment, the inverted pleat must, before sewing, be spread out flat so that the crease edges remain in coincidence. To do so is not possible with the apparatus according to German GM No. 80 27 080. It requires great attention and is a weak point in the marking of garments with inverted pleats because displacements can easily occur in spreading.

SUMMARY OF THE INVENTION

According to the invention, a sewing device operates in such a way that the inverted pleats can, in the charging position of the pleating bar, be correctly aligned in a simple manner and can be brought into the position of the transfer to the feed pressure bar in a sewing position without displacement.

The dimensions of the pleating bar adjusted to the center part of an inverted pleat on the visible side of the garment, in conjunction with the position of its contact edge for a pre-ironed crease of the inverted pleats in the direct field of vision of the seamstress, facilitates the correct alignment of the inverted pleats, and by the fixation in the aligned position inaccuracies due to displacement during changeover from the charging position to the transfer position are prevented.

In one embodiment of the invention, a pre-ironed inverted pleat can very easily be slipped from the side onto the pleating bar present in the vertical extended charging position and be aligned. With the fixation of the inverted pleat in its aligned position and with the rotation of the pleating bar sections into the closed position in which the width of the pleating bar approximately corresponds to one half the width of an inverted pleat, the spreading poses not problems and ensures the exact working of the inverted pleats.

The apparatus may also be used for making inverted pleats of different widths having various appropriate design variants.

Accordingly, it is an object of the invention to provide a device for use with a sewing machine for making garments with pleats using a folded over workpiece material between the folds of which the device is insertable, and which includes a support member which carries a pleating bar assembly which receives the folds of the garment to position a pleat and a needle bar with needles to fix the position of the pleat on the pleating bar.

A further object of the invention is to provide a device for forming pleats in a sewing machine which includes a pleating bar assembly which receives the garment and moving needles which engage into the material and which together with the pleating bar assembly hold the material as it is advanced into association with the sewing needle.

A further object of the invention is to provide a device for use with sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 7 is an elevational view of a second embodiment of the pleating bar with its drive;

FIG. 8 is a top view of the pleating bar according to FIG. 7;

FIG. 9 is a section along line IX—IX in FIG. 8;

DESCRIPTION OF THE PREFERRED EMBODIMENTS

Figures 1, 4, 5, 6, 10:
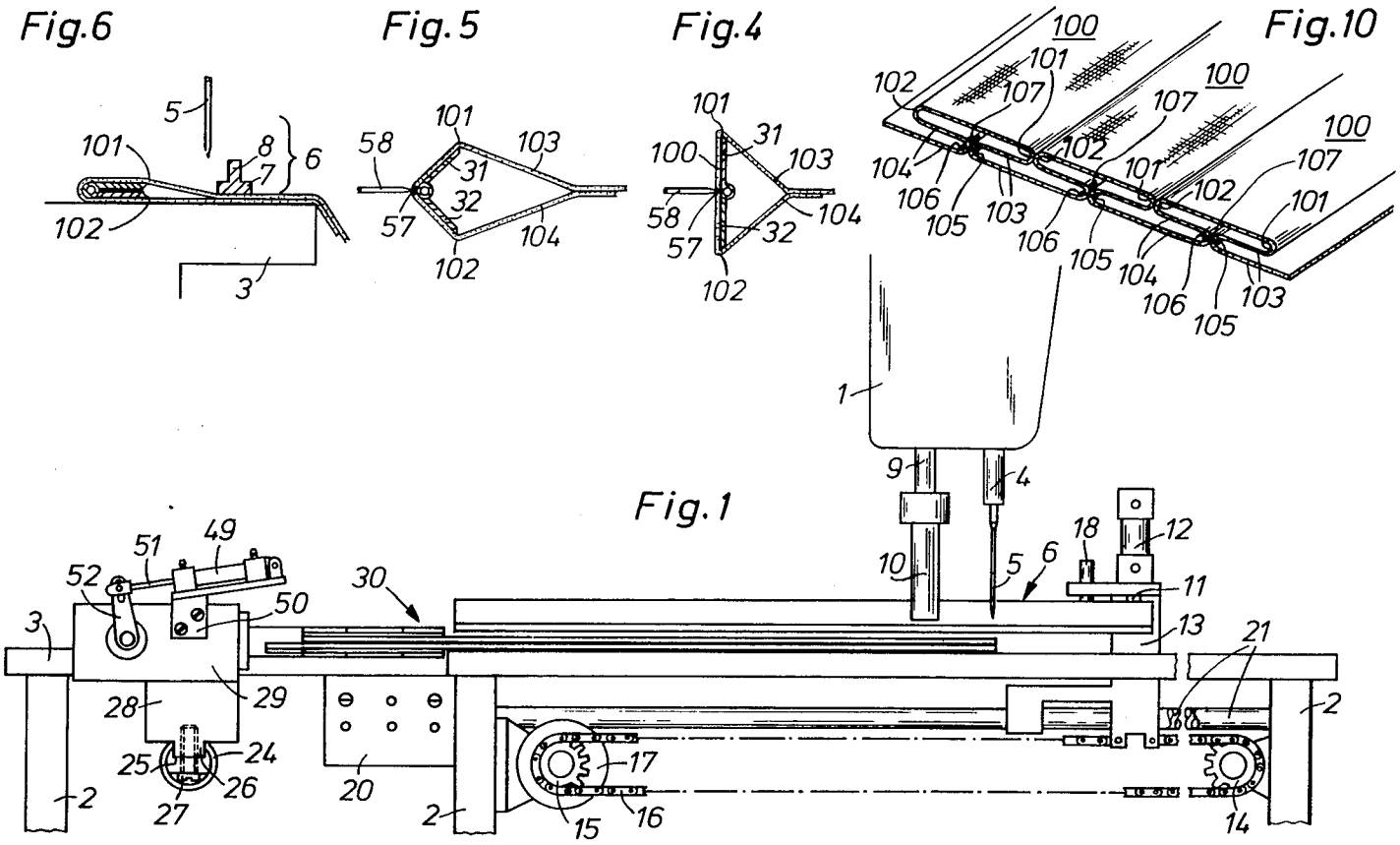
FIG. 1 shows a simplified elevational view of an apparatus for making garments with inverted pleats equipped with a first model of the pleating bar.
FIGS. 4 to 6 are schematic sectional views of three different work phases in aligning and feeding an inverted pleat.
FIG. 10 is a perspective basic representation of inverted pleats.
Figure 2:
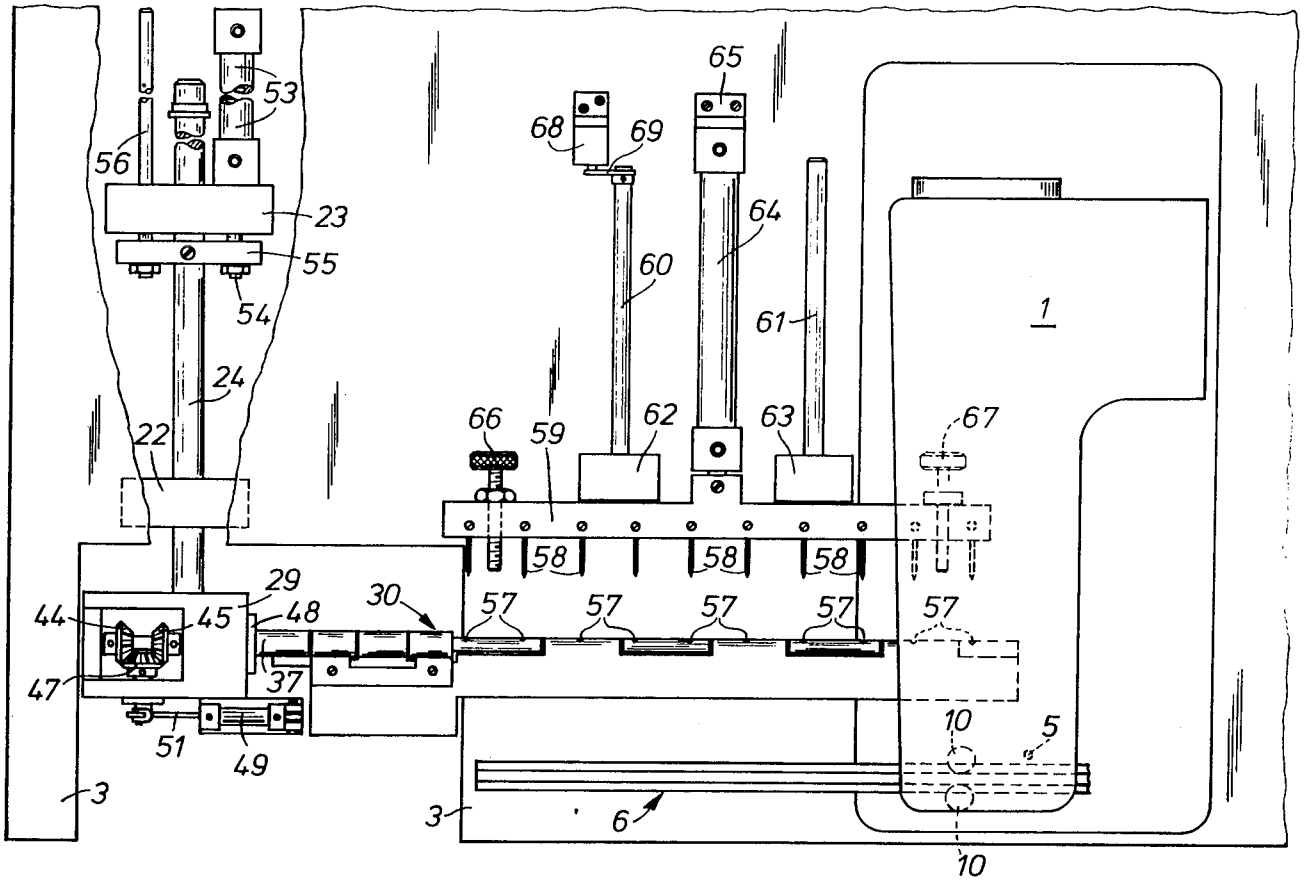
FIG. 2 is a top view of the apparatus according to FIG. 1.
Figure 3:
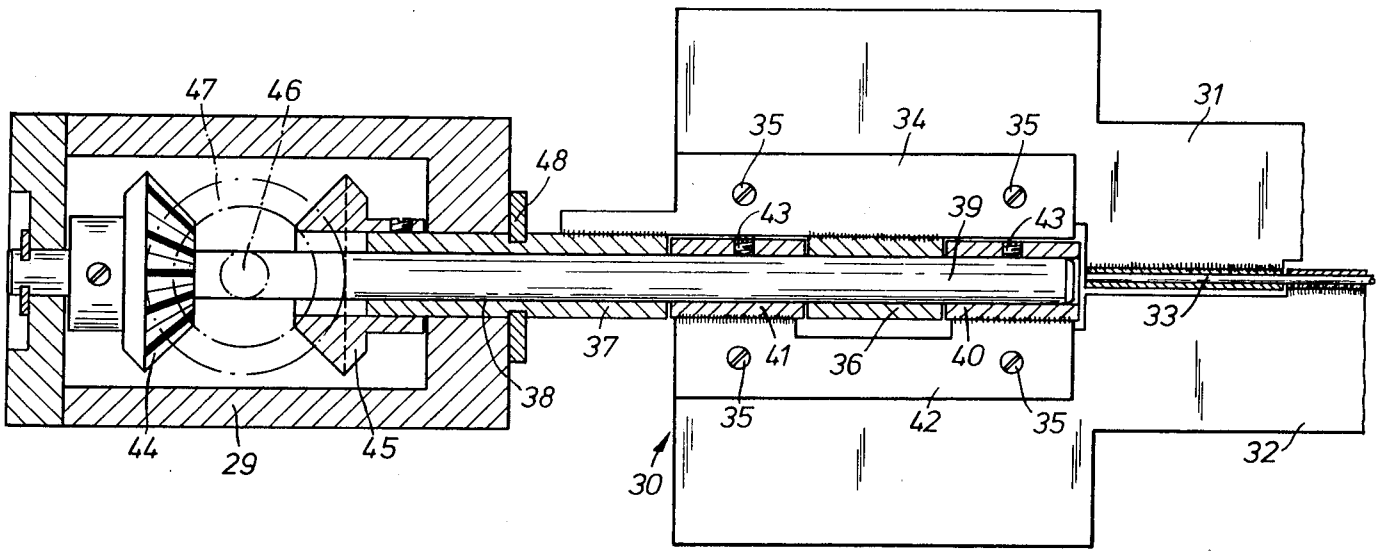
FIG. 3 is an enlarged representation of one embodiment of the plastic bar, partly in section.

Referring to the drawings in particular the invention embodied therein in FIGS. 1 to 5 comprises a device for use with a sewing machine 1 for making garments with pleats such as inverted pleats 100 as shown in FIG. 10, which uses a folded-over workpiece W as shown in FIGS. 4, 5, 6 and 10. In accordance with the invention, the device is insertable between the folds of the workpiece W as indicated in FIG. 6. A support member such as a shaft 39 is shown in FIG. 3 for a pleating bar assembly generally designated 30 which is insertable between the folds of the material. The pleating bar assembly includes at least two movable plate members which in the embodiment of FIGS. 1 to 6 comprises plate members or sections 31 and 32 which may be moved by actuator means into a flat position indicated in FIG. 6 from an expanded position indicated in FIG. 4 so as to first position the workpiece and then to move it to a sewing location. Drive means such as a fluid pressure operated cylinder 53 in piston rod 54 are connected to the pleating bar assembly 30 so as to facilitate movement of the material with a work feed pressure strip 6 which engages the material past a reciprocating sewing needle 5 as shown in FIG. 1.

The apparatus comprises a sewing machine 1 which is fitted into a sewing table plate 3, carried by a frame 2, with its arm shaft longitudinal axis substantially perpendicular to the front edge of the sewing table plate 3. Fastened on a needle bar 4 of the sewing machine 1 is the thread carrying needle 5, which cooperates with a shuttle (not shown) for seam formation. The sewing machine is driven in known manner by a stop motor arranged below the sewing table plate 3 and can be stopped in a predetermined position of its sewing tools, e.g. with the needle up. The work feed device is a feed pressure strip 6 of inverted T-shaped cross section whose base 7 is covered with a grippy material such as foam plastic. The web 8 of the feed pressure strip 6 is guided between two studs 10 fastened on the presser bar 9 of the sewing machine 1.

The piston rod 11 of a compressed air cylinder 12 pushes the feed pressure strip 6 down onto the work to be transported. The compressed air cylinder 12 is arranged at a drive 13 which is fastened at a chain 16 passed under the sewing machine plate 3. The chain is guided over sprocket wheels 14 and 15 and drives the feed pressure strip 6. The chain 16 is driven by the sprocket 15 which is rotated by a drive motor 17 secured on the frame 2. For a straight guiding there is fastened on the feed pressure strip 6 a stud 18 which slides in a guideway provided at the upper end of drive 13.

The device is controlled by a control unit 20 which contains means for the sequential control of the individual movements, and the operation of the sewing machine can be controlled by micro-switches or photocells (not shown).

The driver 13, connected with the chain 16, is displaceable on two guide rods 21 extending parallel to each other and to the front edge of the sewing table plate 3 and arranged below the latter on the frame 2. Mounted below the sewing table plate 3 further a non-rotational rod 24 slidable in bearing brackets 2, 23 (FIG. 2) perpendicular to the guide rod. The rod 24 has a groove 25 in which is inserted the rib 26 of a guide block 28 secured on rod 24 by screws 27.

Exchangeably fastened on the guide block 28 is a housing 29 which serves to receive a pleating bar 30 and its drive device. The pleating bar 30 shown in FIGS. 1 to 3 consists of two sections 31 and 32, which are rehinged together by a hinge pin 33. Section 31 is fastened by screws 35 to a swivel bearing 34 which is rigidly connected with a bearing lug 36 and a bearing sleeve 37. The bearing sleeve 37 is mounted for rotation in a bore 38 of housing 29. Coaxial with the bearing sleeve 37 is a shaft 39 which is passed through two bearing lugs 40, 41 of a swivel bearing 42 screwed to the section 32 by screws 35 and through the bearing lug 36 and on which the swivel bearing 42 is secured by screws.

On shaft 39 is fastened a bevel gear 44 disposed in housing 29, and on bearing sleeve 37 a bevel gear 45. Both bevel gears 44,45 are in drive connection with a bevel gear 47 secured on a shaft 46 in housing 29. The axial fixation of the bearing sleeve 37 is provided by a lock ring 38 together with bevel gear 45.

To actuate the hinged pleating bar sections 31 and 32 there is used a pneumatic cylinder 49, whose housing end is articulated to a bracket 50 fastened on housing 29 and whose piston rod 51 is articulatedly connected with a crank 52 secured on shaft 46. By appropriate control the compressed air supply to the pneumatic cylinder 49, the sections 31, 32 of the pleating bar 30 are movable between an extended postion (FIGS. 3,4) and a closed position (FIGS. 2,6).

The pleating bar 30 is displaceable together with its drive under the raised feed pressure strip 6 between a charging position (FIG. 4) before the sewing machine 1 and a transfer position (FIGS. 1,26) by drive means in the form of a pneumatic cylinder 53, whose housing is fastened at the bearing bracket 23 and whose piston rod 54 engages at a drive 55 adjustably fastened on the sliding rod 24. The sliding rod 24 is secured against rotation by a rod 56 which is fastened in the drive 55 and guided in a bore of the bearing bracket 23.

In the hinge area of the pleating bar 30, cutouts 57 are provided for the entrance of fixing pins 58 for the inverted pleat drawn onto the pleating bar 30; they are inserted and secured in a needle bar 59. The needle bar 59 is attached to two sliding rods 60, 61 which are displaceable in bearing shoulders 62, 63 of the frame 2. They are displaced by a double-action compressed air cylinder 64 which is secured on an angle-piece 65 of frame 2.

To determine the depth of penetration of the fixing pins 58, two adjusting screws 66, 67 are provided on the needle bar 69. In the starting position of the needle 59 a limit switch 68 is arranged, which is actuated by a switching arm 69 on rod 60.

The pleating bar illustrated in FIGS. 7 to 9 as a second embodiment is marked 70. It comprises a section 71 of U-shaped cross section, in which a thin section 72 is displaceable lengthwise and crosswise. This section 72 has a contact edge 73, which in the charging position lies in the direct field of vision of the seamstress.

Press-fitted into bores of this section 72 are two guide pins 74 which on both sides protrude outward into slots 75 in the legs of the U-shaped section 71. The slots 75 are oriented obliquely to the contact edge 73, to bring about upon longitudinal displacement of section 72 the transverse displacement thereof and hence a variation of the width of the pleating bar 70. To work inverted pleats of different widths, the pleating bar 70 can be adjusted to half the width of an inverted pleat.

The U-shaped section 71 with the section 72 between its legs is firmly connected with a holder 76, e.g. by soldering, and screwed with screws 77 to vertical cross-pieces 78,79 of a slide 80. Slide 80 is displaceable on a slideway 82 fastened by screws 81 to the guide block 28, the sides of the guideway being engaged from below by strips 83 on the underside of slide 80.

For the engagement of an adjusting member 84 there is provided a stud 85 fastened in the pleating bar 70 and projecting downward into a slot 86 in the adjusting member 84. Screwed through a threaded bore of the adjusting member 84 is a threaded spindle 87 which rotates in the cross-pieces 78,79 of slide 80 and is secured against axial displacement by a setting ring 88 and a knurled knob 89.

To fix the aligned inverted pleat on the pleating bar 70 in its position for bringing it into the transfer position, section 71 has cutouts 90, indicated by broken lines in FIG. 8, for the fixing pins 58 of the needle bar 59.

To partially extract the pleating bar 70 out of the inverted pleat to the left with respect to FIGS. 7 and 8, after the garment has been taken over by the feed pressure strip 6, there is screwed to cross-piece 78 of slide 80 a small plate 91, at which engages the piston rod 92 of a double action pneumatic cylinder 94 secured on the upwardly bent end 93 of the slideway 82.

The pleating bar 30 with its drive in the housing 29 could be arranged on slide 80 instead of the guide block 28 and could be partially extractable from the inverted pleat like the pleating bar 70.

An inverted pleat, of which three are shown in FIG. 10 in a basic representation, has a center part 100 between two crease edges 101, 102 and under it two fold parts 103, 104 which are sewn together at their abutting fold edges 105, 106 by a seam 107.

Procedure:

It is assumed that in its starting position the feed pressure strip 6 is lifted off the sewing table plate 3 with the sewing machine 1 stopped in needle-up position, the needle bar 59 is in its starting position according to FIG. 2, and the pleating bar 30 has been moved through under the feed pressure strip 6 into its charging position before the front edge of the sewing table 3 in which the sections 31, 32 are extended and vertical according to FIGS. 3 and 4. From the free end of the pleating bar 30, one of the inverted pleats of a garment, whose crease edges 101, 102 and fold edges 105, 106 are pre-ironed before being worked, are drawn onto the pleating bar 30 and aligned in such a way that the crease edges 101, 102 apply against the outer edges of the sections 31, 32 and hence are arranged one above the other. By the compressed air cylinder 64 the needle bar 59 is then displaced toward the pleating bar 30, and the aligned inverted pleat is fixed in its position on the pleating bar 30 by the fixing pins 58 piercing the cloth in the area of the hinge axis of the two sections 31, 32. The depth of penetration of the pins 58 is adjustable at the adjusting screws 66, 67.

The pleating bar 30 with the inverted pleat of the garment secured in position by the fixing pins 58 is then displaced together with the needle bar 59 by the compressed air cylinders 53,64 passing under the feed pressure strip 6 into the transfer position according to FIGS. 2 and 6, with simultaneous rotation of sections 32 and 31 into the closed position. In so doing, the inverted pleat is spread out flat. As soon as the transfer position is reached, the displacement path is predeterminable by variation of the position of the drive 55 on the slide bar 24 for adaptation to inverted pleats of different widths, the feed pressure strip 6 is lowered by the compressed air cylinder 12, the needle bar 59 is pulled back by the compressed air cylinder 64 into its starting position determined by the limit switch 68, and, in case of arrangement of the housing 29 on the slideway 82, the pleating bar 30 is partially extracted out of the inverted pleat toward the left with respect to FIGS. 1 and 2 by the compressed air cylinder 53, and the sewing machine 1 and the motor 17 are started. The work is then transported by the feed pressure strip 6 in accordance with the form of the seam 107 to be placed through the abutting fold edges 105, 106, possibly with lock-stitching of the beginning and end, through the stitch-forming point of the sewing machine. At the end of seam 107 the motor 17 is turned off, the sewing machine is stopped in needle up position after the cutting of the threads, and the feed pressure strip 6 is raised. The garment with the sewn inverted pleat is pulled off the feed pressure strip 6, the feed pressure strip 6 and the pleating bar 30 return of their starting position, and after the next inverted pleat has been drawn onto the pleating bar 30 and after aligning the described cycle can start anew.

The procedure when using the variable width pleating bar 70 instead of the hinged sections 31, 32 differs only in that the inverted pleat, slipped onto the pleating bar 70 from the side, must be aligned with a crease edge 101 applied against the contact edge 73 and guided with the center part 100 around the pleating bar 70, whereupon the inverted pleat is fixed on the pleating bar 70 by the fixing pins 58 piercing the cloth.

The width of the pleating bar 70 is variable by rotation of the spindle 87 and can be adapted exactly to one half the width of the center part 100 of the inverted pleat. Therefore, inverted pleats of different widths can be worked with the pleating bar 70.

Upon rotation of the spindle 87, the adjusting member 83 shifts parallel to the longitudinal axis of the pleating bar 70 and in so doing takes along the section 72 via the stud 85 in section 72 protruding into the slot 86. By the pins 74 protruding into the oblique slots 75 in section 71, section 72 is then displaced crosswise to the longitudinal axis of the pleating bar 70.

After the drawing up, aligning and fixing of an inverted pleat in the charging position of the pleating bar 70, the bar and the needle bar 59 are moved by the compressed air cylinders 63 and 64 into the transfer position. As has been described before, the feed pressure bar 6 is then lowered, the needle bar 59 is pulled back by the compressed air cylinder 64 to its starting position determined by the limit switch 68, and the pleating bar 70 is partially retracted from the inverted pleat toward the left with respect to FIGS. 7 and 8, by the compressed air cylinder 94. As has been described before, the seam 107 is then formed and there follows the further sequence to removal of the sewn inverted pleat from the pleating bar 70 and the preparations for a new cycle.

While specific embodiments of the invention have been shown and described in detail to illustrate the application of the principles of the invention, it will be understood that the invention may be embodied otherwise without departing from such principles.

What is claimed is:

1. In an apparatus including a sewing machine having a stitch forming point for making garments with preformed pleats which comprise two oppositely directed fold parts lying under a continuous center part with respective crease edges and the juncture of the center and fold parts and having fold edges at the ends of the fold parts, and which have continguous fold edges which are sewn together over a predetermined length to form inverted pleats, and in which after a pleat has been correctly positioned on a pleating bar movable between a charging position and a transfer position which determines the position of a seam and which also includes a feed presser strip engageable with the garment in the area to be sewn and which is movable to transport to garment through the stitch forming point of the sewing machine, comprising a pleating bar having a width equal to substantially the half width of the center portion of said inverted pleat and having a contact edge for the inverted pleat in the direct field of vision of an operator, said bar having fixing pin cutouts, a needle bar having a plurality of needle bar fixing pins movable relative to said pleating bar for the aligned inverted pleat, and having fixing pins engageable in respective cutouts, the displacement paths of said pleating bar and said needle bar between a charging and a transfer position being predetermined.

2. In an apparatus according to claim 1, wherein said pleating bar comprises two sections each having a hinge portion and a support member pivotally supporting said sections to permit them to be swung outwardly into an extended substantially vertical position for receiving a pleat and collapsed into a flattened position for the transfer of the material.

3. In an apparatus according to claim 2, including a bevel gear drive connected to said pleating bar for opening and closing said section, said drive having means for setting said drive at predetermined driving extents to vary the width of the pleats.

4. In an apparatus according to claim 1, wherein said pleating bar comprises a section of U-shaped cross section having a central portion joining two leg portions, the central portion forming a contact edge engageable between the folds of the material.

5. In an apparatus according to claim 4, wherein one section has a slot extending obliquely to the contact edge and a guide pin of the other section engaged in the slot so as to be confined for movement relative to the first section.

6. In an apparatus according to claim 5, including an adjusting member for displacing one section relative to the other.

7. In an apparatus according to claim 6, including a slide connected to said pleating bar, a rail on which said slide is movable arranged parallel to the longitudinal axis of said pleating bar, setting means connected to said slide for determining length of movement thereof.

8. A device for use with a sewing machine for making garments with pleats using a folded over workpiece material between the folds of which the device is insertable, comprising a support member, a pleating bar assembly carried by said support member being insertable with a portion of said support member between the folds of the material and including at least two movable plate members, actuator means carried by said support member to move said plate member from an expanded position for receiving a pleat to a collapsed position and drive means for moving said support for positioning it in respect to the workpiece.

9. A device according to claim 8, including securing pin means movable toward and away from said pleating bar assembly for engaging the workpiece when a pleat is on said pleat members.

10. A device according to claim 9, wherein said pin means comprises a needle bar, a slide carrying said needle bar permitting movement of said needle bar toward and away from said pleating bar assembly, said needle bar carrying a plurality of spaced apart pins, said pleating bar assembly having openings at spaced locations comparable to the needles to permit entrance of the needles therein and into a pleat on the plate members for holding the workpiece during movement of the pleat into a sewing position.

11. A device according to claim 10, wherein said sewing machine includes a work feed pressure strip engageable with the garment at a spaced location from the folded edges being movable with the garment past the sewing needle to effect the formation of a sewing stitch.

12. A device according to claim 8, wherein said pleating bar assembly includes two parallel pleat portions having edges which are at a common location for bearing against the folded edge of the workpiece, a holder carrying said plates and means for shifting said holder with said plates comprising said drive means.

* * * * *